United States Patent [19]

Emi et al.

[11] Patent Number: 4,748,703

[45] Date of Patent: Jun. 7, 1988

[54] COMFORTER

[76] Inventors: Suzuki Emi; Suzuki Takahiro; Suzuki Hiroko, all of 32-11, Toneyama 6-chome, Toyonaka-shi, Osaka, Japan

[21] Appl. No.: 940,983

[22] Filed: Dec. 12, 1986

[30] Foreign Application Priority Data

Jul. 25, 1986 [JP] Japan ..... 61-176324

[51] Int. Cl.[4] ..... A47G 9/02

[52] U.S. Cl. ..... 5/502; 5/482

[58] Field of Search ..... 5/502, 500, 485, 486, 5/482

[56] References Cited

FOREIGN PATENT DOCUMENTS 520365 6/1953 Belgium ..... 5/502

199143 10/1938 Switzerland ..... 5/502

22878 of 1903 United Kingdom ..... 5/502

*Primary Examiner*—Alexander Grosz

*Attorney, Agent, or Firm*—Koda and Androlia

[57] ABSTRACT

A comforter to be used when sleeping made by joining a front cover cloth and a back cover cloth by sewing their edges together. The inside of the comforter is divided into a plurality of spaces by crosswise parting members and lengthwise parting members, the height of each of the crosswise parting members becoming lower toward both ends, and each space is filled with down which is soft, fine feathers, etc. Because of the parting members, the down does not move around inside the comforter, and always follow the posture of the person using it, thus snugly covering their body.

12 Claims, 6 Drawing Sheets

COMFORTER

BACKGROUND OF THE INVENTION

1. Field of the Invention

The present invention relates to a futon or comforter (a quilted bed covering) and more particularly to an improved structure of a comforter that is prepared by sewing edge portions of a front cover cloth and a back cover cloth together, then by filling the inside of the thus obtained bag-shaped body with feathers of water birds which is called down.

2. Prior Art

There are several types of comforters. The one shown in FIG. 16 is prepared by sewing a front cover cloth and a back cover cloth together at their edge portions to form a bag, then, after filling the inside of the bag with down, the front cover cloth and the back cover cloth are sewn together into a gridiron pattern (usually, it is called a quilt, with the sewing lines indicated by A). The comforter in FIG. 17 is made by providing, for example, interval maintaining members B, inside the comforter formed into a bag-shape.

The conventional ordinary quilt type comforter as shown in FIG. 16, however, had disadvantages in that the down is partially depressed because the front cover and the back cover cloth are sewn together with the down inserted inbetween, resulting in decreasing the heat insulating effect by half.

The comforter shown in FIG. 17 has interval maintaining members inserted between the front cover cloth and the back cover cloth, but is defective in that the down can move inside the comforter. During use, the center portion of the comforter covering a human body becomes high in height from the floor, and with the movement of the person, such as turning while sleeping, the down in the comforter moves to the side part or the bottom part. As a result, there is a small amount of down in the center portion of the comforter where it is most important to keep the person warm, making it impossible to give sufficient thermal insulation.

SUMMARY OF THE INVENTION

The present invention is intended, therefore, to obviate the foregoing defects of the conventional comforters, and the object of this invention is to provide a comforter with excellent heat retaining property, in which a portion with poor heat insulating effect is not formed, and in which the down filling the inside of the comforter is distributed automatically to be of a large amount in the center portion covering the human body while being distributed to be a small amount in the peripheral portions, even though the down to some extent within the comforter.

The foregoing object of the invention is achieved by a unique structure for a comforter wherein a comforter formed by joining, for example by sewing, a front cover cloth with a back cover cloth at the edges into a bag-shape, and then by filling the inside with down; parting cloth members are provided in a crosswise direction (width direction) at a plural number of positions with specified intervals, from the upper portion to the lower portion of the inside of the comforter.

Each parting cloth member is formed to be high in height at its center portion, and the height becomes lower gradually toward both ends.

In the comforter according to the present invention, the inside is divided into a plurality of spaces which are long in a crosswise direction, by the parting cloth members. The parting cloth member is formed to be high at its center and low at its right and left arms. Therefore, the space in which the down is filled is wide at the center portion and narrow at the side portions of the comforter. Accordingly, the down filling the inside of the comforter naturally is thickly distributed in the center portion.

When the comforter is put on when a person gets into bed, the center portion rises over the other portions. When the comforter is moved by the turning motion of the person, etc., and the down inside the comforter moves sideways, although a slight amount of down may move to the side, more than a specified amount of down does not move to the side portion, because the spaced in the side portions are narrow. Thus, an appropriate amount of down can be retained in the center portion.

BRIEF DESCRIPTION OF THE DRAWINGS

The Figures show the comforter as the embodiments of the present invention, wherein.

DETAILED DESCRIPTION OF THE INVENTION

Hereunder, a description of the embodiments of the present invention will be provided with reference to the drawings.

FIGS. 1 through 4 are plan views of the whole comforter, showing examples of the layout of the parting cloth members, respectively.

Figure 1:
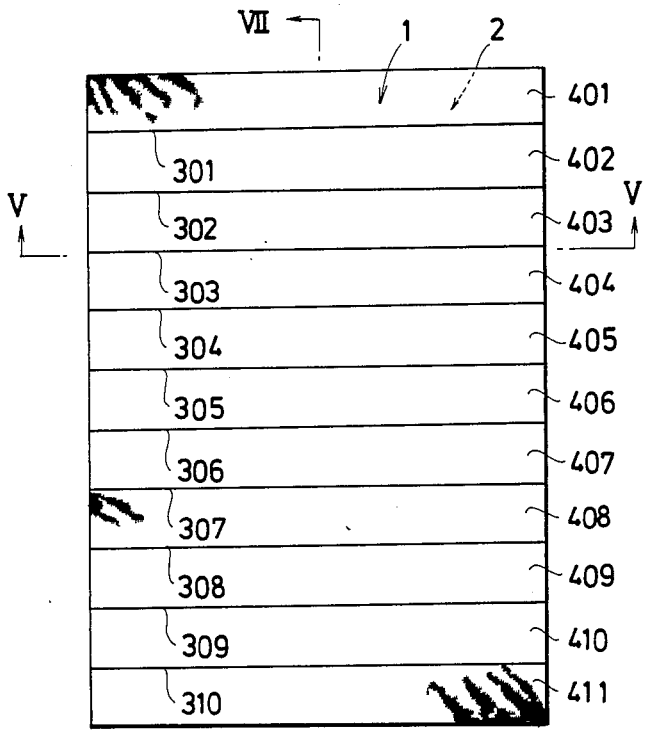
FIGS. 1, 2, 3 and 4 are plan views showing the embodiments of the layouts of parting cloth members, respectively.
Figure 5:
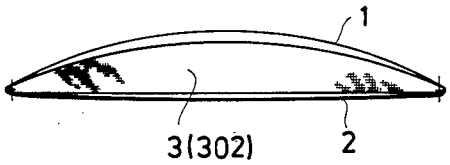
FIG. 5 is a cross sectional view taken along the line V—V of FIG. 1.

In the embodiment shown in FIG. 1, edge portions of a front cover cloth 1 and a back cover cloth 2 are sewn together. Inside of the comforter thus formed into a bag shape, from the upper portion to the lower portion with specified intervals, a plurality of parting cloth members 301 through 310 formed into a protruding arc (convex) shape are provided. The central area of the parting cloth members is high in height and the side portions become gradually lower in height as shown in FIG. 5. In other words, the inside of the comforter is divided into independent spaces 401 through 411 which are long from side to side (oblong). When these spaced 401 through 411 are filled with a specified amount of down, respectively, the down filling the spaced becomes naturally distributed to be in a large amount in the central area.

Figure 2:
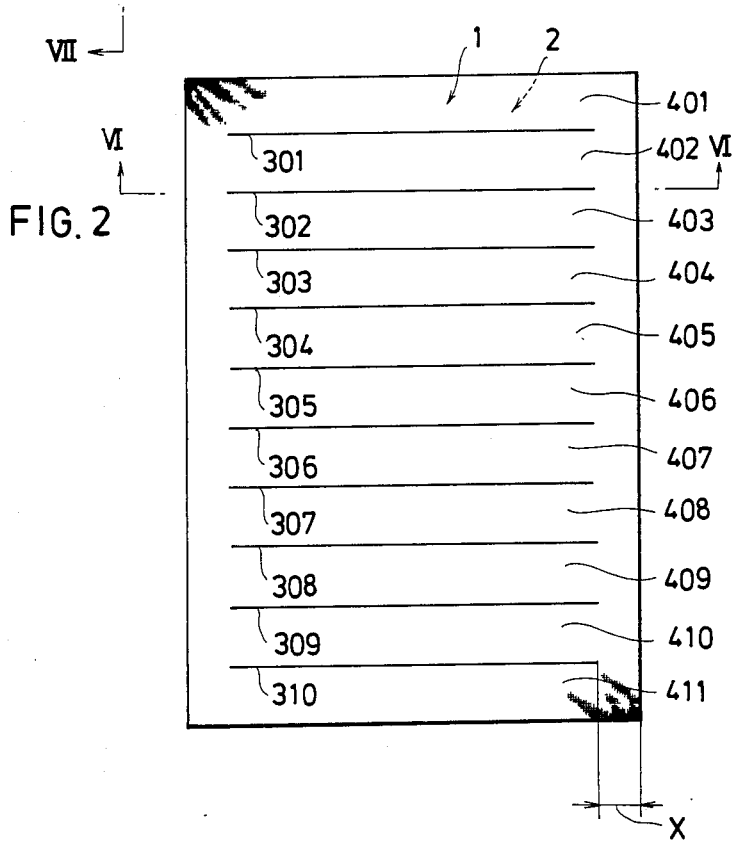

In the embodiment shown in FIG. 2 the length of the respective parting cloth members 301 through 310 shown in FIG. 1 is reduced, and a space X is provided between both the right and left ends of the parting cloth member and the side edges of the comforter. Thus, in this embodiment, the spaces 401 through 411 inside the comforter are mutually connected at side portions. However, as is apparent from FIG. 6, because this connecting portion is relatively small, the down in each of the spaces does not move to the other spaces. In the side edge portions of the comforter, bulged portions are formed in a connected manner from the upper portions to the lower portions. These bulged side edge portions come to contact closely with bed or the surface of a sleeping mat, thereby preventing the outside air from flowing underneath the comforter during sleep. As a result, the comforter provides more warmth.

Figure 3:
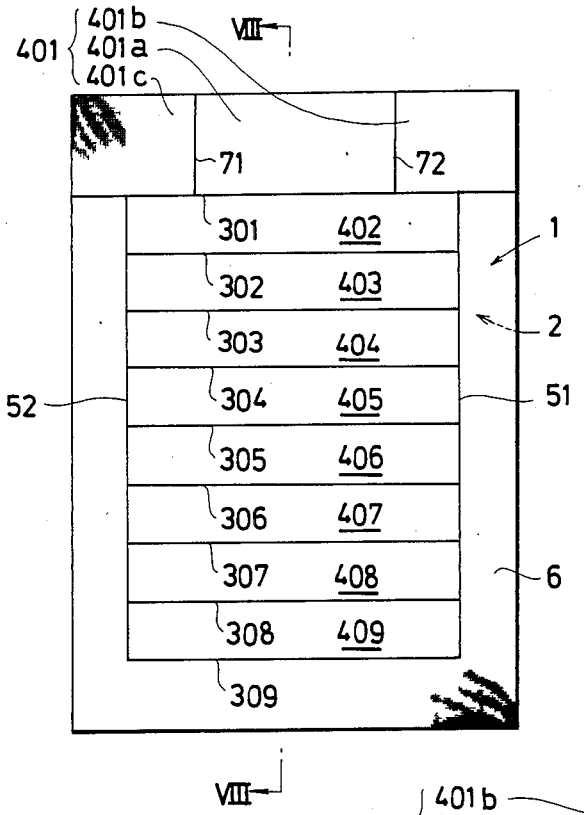

In the embodiment shown in FIG. 3, the inside of the comforter is divided into a peripheral space 6 and a central space by a parting cloth member 309 provided in a crosswise direction at the lowest position and parting cloth members 51 and 52 disposed in a lengthwise direction with a specified width from the side edges of the comforter 1. The central space is divided into independent spaces 401 through 409 by crosswise parting cloth members 201 through 309. Like the embodiment shown in FIG. 2, there is a continuous bulged portion along the edges of the comforter which is the same in its effect as that of the embodiment in FIG. 2. However, in the embodiment shown in FIG. 3, the center spaces 401 through 409 divided by the crosswise parting cloth members 301 through 309 are separated from the peripheral space 6, and the down does not move from the center spaces to the peripheral space 6, and vice versa. Therefore, the width of the peripheral space 6 corresponding to the space X in FIG. 2 can be made a little wider so that the down can move therein. Also, since the heat retaining effect by the down is determined by the quality grade of the down in the center area of the comforter, that part which covers the human body, it may be arranged that the high quality grade down is used to fill the spaces 401 through 409, while using relatively less expensive down, such as small feathers, for filling the space 6, thereby cutting down the cost.

The upper edge portion of the comforter covers the necks and shoulders of the human body. Accordingly, it is desirable to increase the heat retaining capability of that portion. For this reason, in the embodiments shown in FIGS. 3 and 4, the interval between the upper edge of the comforter and the uppermost parting cloth member 301 is made greater than the respective intervals between the parting cloth members 301 through 309. As a result, a relatively large amount of down fills the space between the upper edge of the comforter and the uppermost parting cloth member 301. However, when the width of the space increased, the down can easily move around in the space. Consequently, lengthwise parting cloth members 71 and 72 are provided to divide the space 401 into three smaller spaces 401*a*, 401*b* and 401*c*.

Besides the fact that the comfort provided by the uppermost space 401 increases as its heat retaining capability increases, the inventors have found that it is preferable to design the space 401 to be readily adaptable to the movement of the human body.

Figure 8:
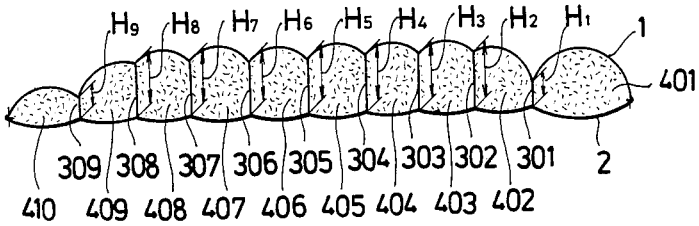
FIG. 8 is a sectional view taken along the line VIII—VIII of FIG. 3.

To improve the heat retaining capability by filling the space with a larger amount of down is contradictory to the requirement to make the comforter easily adaptable to the movement of the human body. The following measures were taken to satisfy both of these requirements. The space between the upper edge of the comforter and the uppermost parting cloth member 301 is made larger than the respective spaces between the parting cloth members 301 through 309. At the same time, as shown in the embodiment of FIG. 8, the height H1 of the uppermost parting cloth member 301 is made lower than the height H2 through H8 of the other parting cloth members 302 through 308, so that the upper edge portion of the comforter can move easily. Furthermore, in the embodiment shown in FIG. 8, since the crosswise parting cloth member 309 at the lowest portion divides the comforter into a center portion and a peripheral portion, its height H9 is low.

Figure 4:
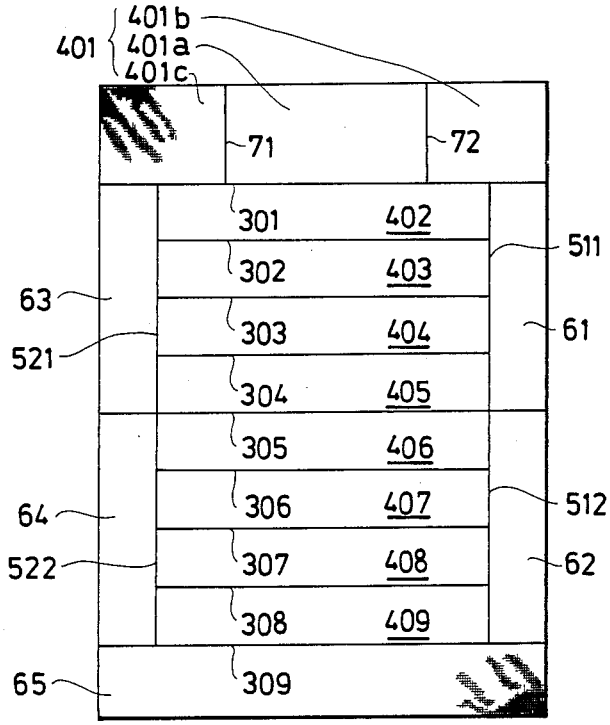

The embodiment shown in FIG. 4 is a modification of the embodiment shown in FIG. 3. In this embodiment, the parting cloth member 305, in the middle position, and the parting cloth member 309, at the lowest position, extend to the side edges of the comforter, thereby dividing the peripheral space into five spaces 61 through 65. With this structure, unnecessary and arbitrary movement of the down in the peripheral area is prevented. Also, the parting cloth members 51 and 52 in the lengthwise direction are separated in the middle by the parting cloth member 305 which extends sideways. Thus, these lengthwise parting cloth members 51 and 52 become parting cloth members 511 and 512 and 521 and 522 (see FIGS. 11 and 12).

Figure 9:
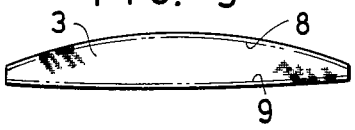
FIGS. 9 and 10 are front view showing the examples of parting cloth members, respectively.
Figure 10:
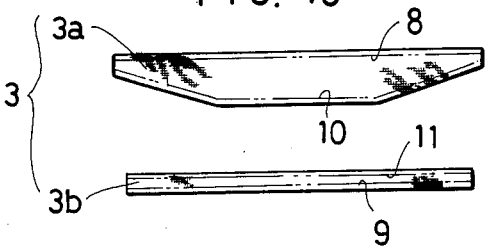

The crosswise parting cloth members 301 through 309 and the lengthwise parting cloth members 51, 52, 71 and 72 may each be formed as a single parting cloth member 3 as shown in FIG. 9. The upper side portion may be sewn to the front cover cloth 1 or the comforter, along the sewing line 8, while sewing its lower side portion to the back cover 2 of the comforter, along the sewing line 9. It is also possible to compose each of the above mentioned parting cloth members of two pieces: an upper parting piece 3*a* to be sewn to the front cover cloth and a lower parting piece 3*b* to be sewn to the back cover cloth of the comforter, as shown in FIG. 10. When using pieces 3*a* and 3*b*, parting cloth member 3 is completed if the upper parting piece 3*a* and the lower parting piece 3*b* are sewn together along the sewing lines 10 and 11.

Figure 11:
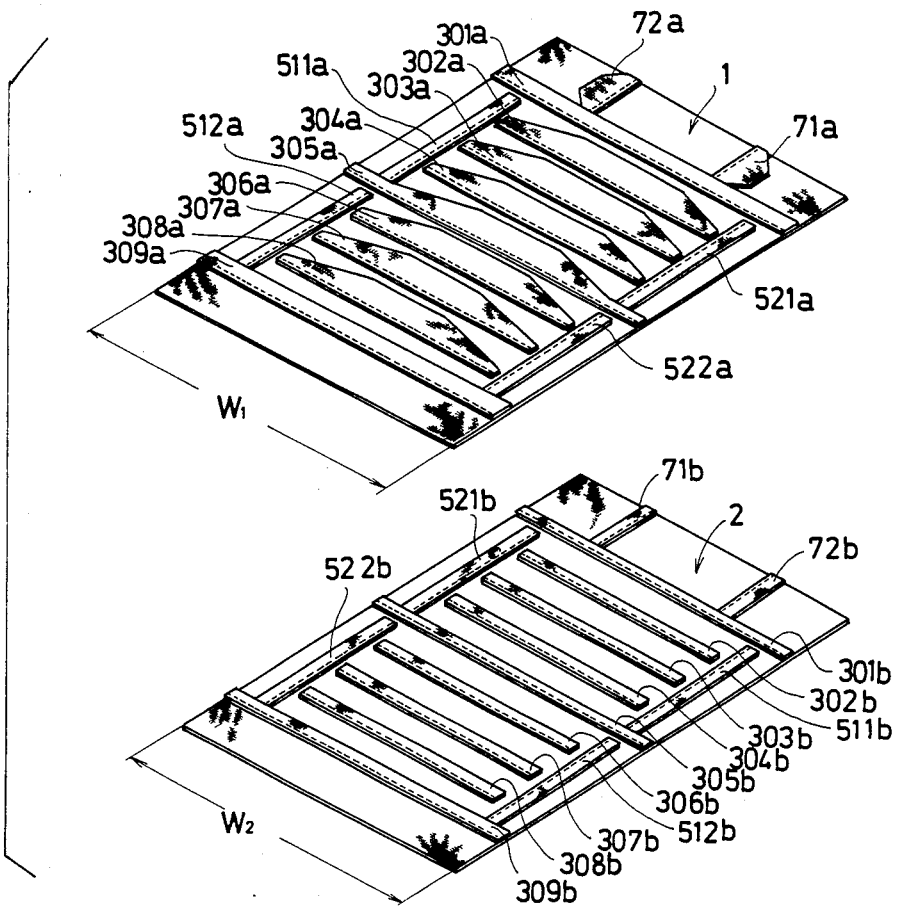
FIG. 11 is a perspective view showing the state in the middle of sewing as an embodiment using the parting cloth members in FIG. 10 with the layout thereof as shown in FIG. 4.

When the parting cloth member 3 is composed of two parting pieces 3*a* and 3*b*, it is possible, as shown in FIG. 11, to flatly sew the upper parting pieces 301*a* through 309*a*, 511*a*, 512*a*, 521*a*, 522*a*, 71*a* and 72*a* to the front cover cloth 1, while flatly sewing the lower parting pieces 301*b* through 309*b*, 511*b*, 512*b*, 521*b*, 522*b*, 71*b* and 72*b* to the back cover, respectively, by using, for example, an automatic sewing machine. As a result, the sewing can be efficiently done with the respective pieces sewn to the correct positions.

The shape of the upper parting piece 3*a* and the lower parting piece 3*b* is optional as long as they meet the requirements of this invention when they are completed as the parting piece 3*a* and the lower parting piece 3*b*, as shown in FIG. 10, the length of the sewing line 10 and the length of the sewing line 11 of the respective parting pieces are not necessarily the same. In such a case, the sewing can be done by making tucks in one of the parting cloth pieces.

Figure 13:
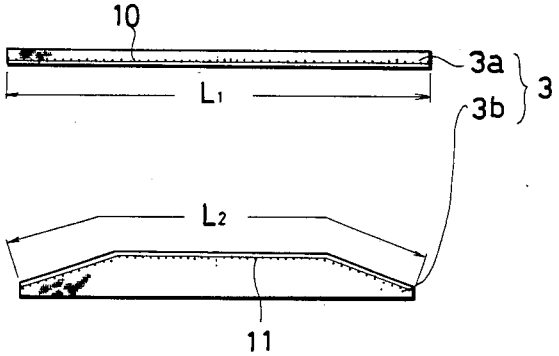
FIG. 13 is a front view of one example of parting cloth members.

FIG. 13 shows an example for making it easy to join the upper parting piece 3*a* to be sewn to the front cover cloth 1 and the lower parting piece 3*b* to be sewn to the back cover cloth 2, by stitching. The lower parting piece 3*b* to be sewn to the back cover cloth 2 is formed into a protruding arc shape, and the upper parting piece 3*a* to be sewn to the front cover cloth 1 is formed into a tape-like shape. With the arrangement of making the lower edge length L1 of the upper parting piece 3*a* and the upper edge dimension L2 of the lower parting cloth piece 3*b* nearly the same as each other, both pieces may be sewn together efficiently without making tucks as in the case mentioned previously.

In the Figure, the sewing lines 10 and 11 for sewing the upper parting piece 3*a* and the lower parting piece 3*b* together are provided with marks for sewing the pieces together by matching them correctly.

Figure 14:
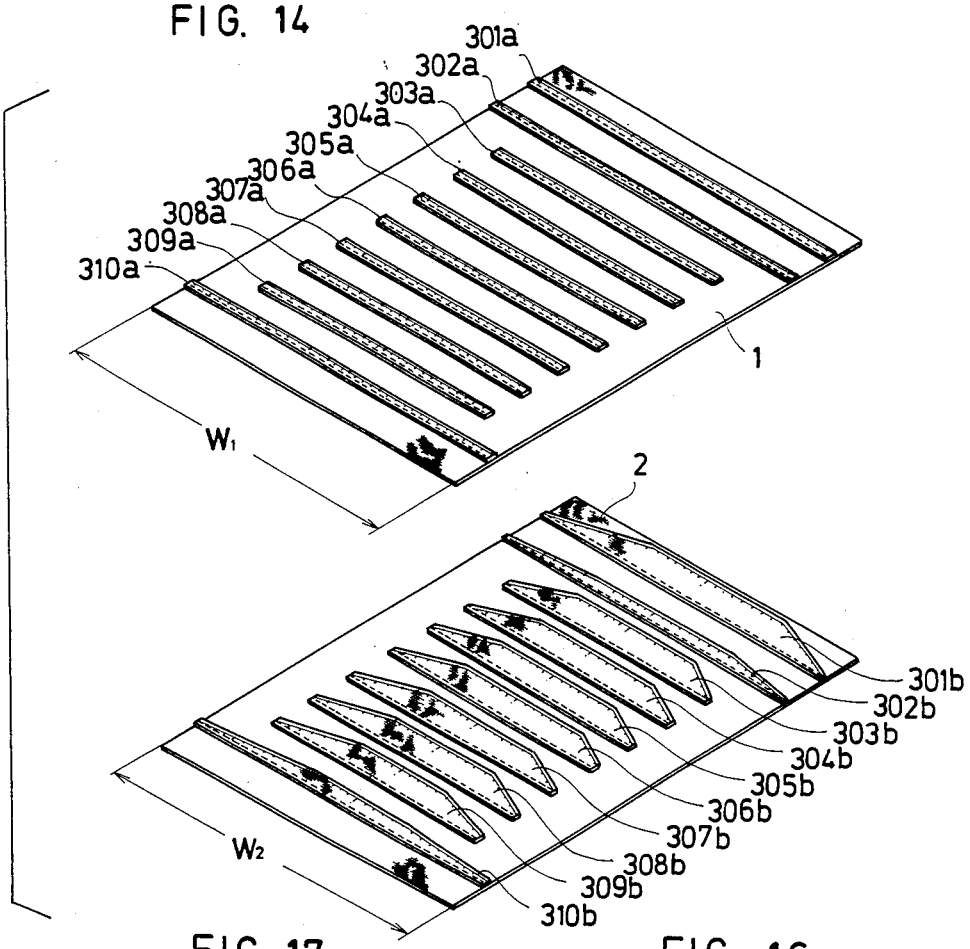
FIG. 14 is a perspective view of the states in which an upper parting cloth pieces are sewn to a front cover cloth, and a lower parting cloth pieces are sewn to a back cover cloth, respectively.
Figure 17:
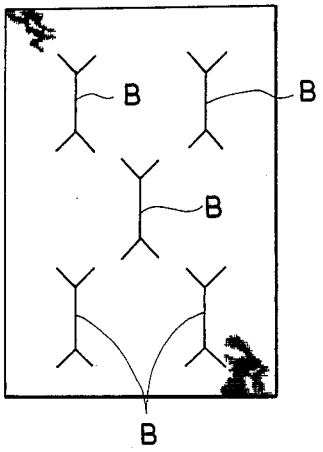
FIG. 17 Prior Art
FIGS. 16 and 17 are plan view showing the examples of the conventional comforters, respectively.

The embodiment shown in FIG. 14 uses the parting pieces 3*a* and 3*b* shown in FIG. 13. In FIG. 14 the crosswise upper parting pieces 301*a* through 310*a* are sewn to the front cover cloth 1 while the crosswise lower parting pieces 301*b* through 310*b* are sewn to the back cover cloth 2. In this embodiment, the distance between the uppermost parting cloth member 301 and the upper edge of the comforter is set to be relatively small, and the height of the parting cloth member is made high. Also, the height of the parting member 302 next the uppermost one is made low. Thus, the comforter is made easy to adapt to the movement of the head and arms of a person during sleep.

Figure 6:
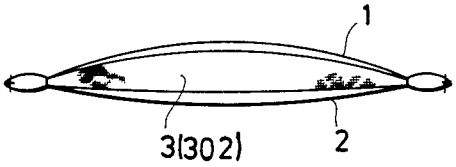
FIG. 6 is a sectional view taken along the line VI—VI of FIG. 2.
Figure 12:
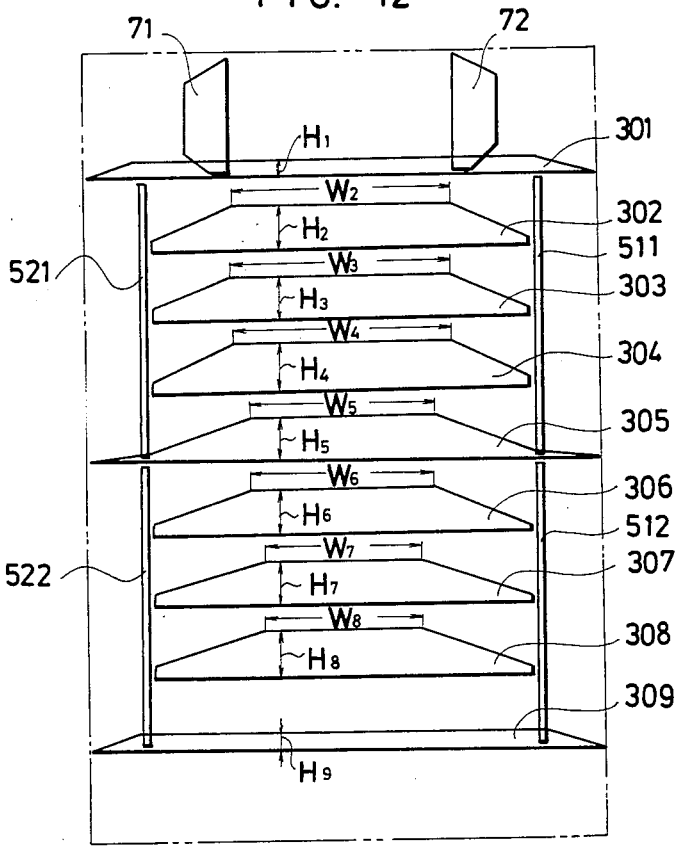
FIG. 12 is a plan view showing an example of the forms of the respective parting cloth members of the embodiment in FIG. 4.

FIG. 12 shows forms (heights) of the respective parting cloth members. The crosswise parting cloth members 301 through 309 may be formed into, for example, a protruding arc shape with the center part becoming highest in height as shown in FIGS. 5 and 6. It may also be formed into a trapezoidal shape as a whole, with a certain range of the center area becoming highest in height as shown in FIG. 12.

As mentioned above, in the present invention, the inside space of the comforter is divided into a large number of spaces 401 through 411 by the crosswise parting cloth members 301 through 310. Also, in order to hold a large amount of down in the center portion of the comforter which covers the human body, the heights H1 through H10 of the center portions of the parting cloth members are designed to be high, and height is gradually lowered toward the sides. The central area containing a large amount of down may be made the same for the upper portion and the lower portion of the comforter. However, as is understood from the fact that the surface area of the human body is by far larger in the upper half than the lower half, it is reasonable and desirable to distribute the larger amount of down in the upper portion of the comforter which will cover the upper half of the human body.

For effecting distribution of a larger amount of the down in the upper portion of the comforter than in the lower portion of the comforter, the following two embodiments are feasible.

Figure 7:
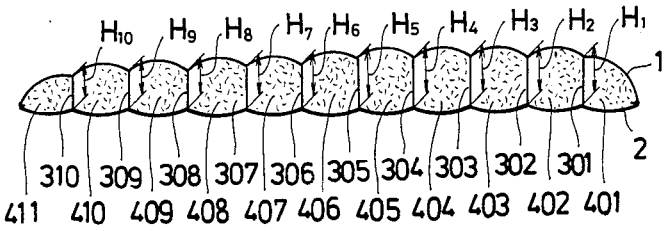
FIG. 7 is a sectional view taken along the line VII—VII of FIG. 1.

One embodiment is, as shown in FIG. 7, to vary the heights H1 through H10 in the center portions of the parting cloth members 301 through 310. In this embodiment, the heights H1 through H5 are arranged to be highest, the heights H6 and H7 to be a little lower, the heights H8 and H9 to be further lower, and the height H10 to be the lowest. In this embodiment, the down can be distributed appropriately proportional to the surface area of the human body. However, there is a possibility that the heat retaining capacity of the comforter which covers the lower ends of the legs, that is, the thickness of the down filling that portion of the comforter, is not necessarily sufficient.

Unlike the above, in the embodiment shown in FIGS. 8 and 12, the whole body of each of the parting cloth members 302 through 308 is formed into nearly a trapezoidal shape, and the heights H2 through H8 of the center portions of the respective parting cloth members are set to be almost the same. Also, the widths W2 through W8 (see FIG. 12) of the center portions of the respective parting cloth members have different sizes.

In FIG. 12, widths W2 through W4 are the widest, W5 and W6 are made slightly narrower and W7 and W8 are made narrowest. The heights of the uppermost parting cloth member 301 and the lowest parting cloth member 309 are made low for the reason explained previously.

In the embodiment mentioned above, in which the widths W2 through W8 are varied without changing the height itself of the center portions of the parting cloth members 302 through 308, a sufficient heat retaining effect (the thickness of the comforter) can be obtained even for the lower portion of the comforter covering the lower half of the human body.

Figure 15:
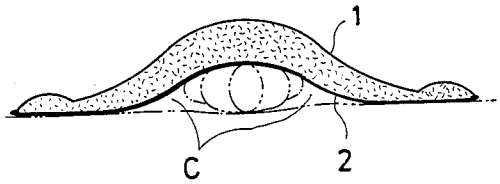
FIG. 15 is a sectional view showing the state of using a comforter according to the present invention.

In the embodiment shown in the Figures, the width W1 of the front cover cloth 1 is made longer than the width W2 of the back cover cloth 2, and the parting cloth members provided in the crosswise direction are formed to be protruding upward, so that the finished comforter bulges toward the front of the cover cloth 1 side as a whole. With such an arrangement provided, as shown in FIG. 15, during sleeping, the comforter follows in conforms to the shape of the human body to snugly wrap the human body. Thus, the gaps C which tend to be formed on both sides of the human body are made minimum, whereby making it possible to obtain the higher heat retaining effect.

For filling the inside spaces of the comforter, which are partitioned by the parting cloth members provided in crosswise and lengthwise directions with the down, it is advisable, for example, to utilize the openings which have not been sewn up yet, which are formed at the side edges of the both ends of the parting cloth members, etc., and also to keep a portion without sewing, at a part of the edge of the comforter, in order to feed the down through it and to sew it up after filling it with down. From this opening, a thin pipe is inserted, and the specified amount of down may be blown into each of the spaces through the pipe.

One example of the order to fill the spaces with the down is given below with reference to FIG. 4. In the Figure, a pipe is inserted from the upper left corner of the comforter, and first, the space 65 is filled, then, the spaces 64, 63, 62 and 61 are filled. Thereafter, the filling will be done to the spaces of the center portion, in the order of the spaces 409 to 402, one after another, and finally, the spaces 401*b*, 401*a* and 401*c* are filled with down.

The comforter according to the present invention is designed to divide the inside of the comforter into a plural number of spaces by parting cloth members provided in the crosswise direction, respectively, and also to make those spaces wide in the center areas and by narrowing the spaced gradually toward the both sides. Therefore, the down filling the spaces is naturally distributed in a large amount in the center portions. Thus, the down inserted into the comforter can be utilized effectively, thereby making the comforter excellent in heat insulating capacity.

Figure 16:
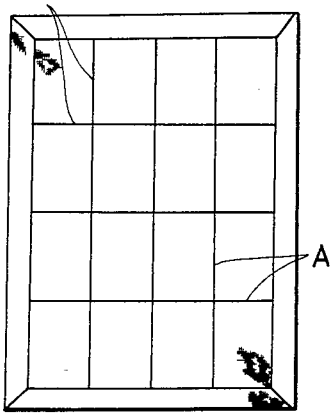
FIG. 16 Prior Art

Furthermore, unlike the quilting lines of a conventional comforter which s shown in FIG. 16 and uses an ordinary quilting pattern, the comforter provided by the present invention does not allow any portions to form which have no heat retaining effect or diminishes the heat retaining effect.

We claim:

1. A comforter of a bag-form body prepared by joining peripheral edges of a front cover cloth and a back cover cloth together with down inside, characterized in that:

a plurality of parting cloth members whose height gradually lowers from the center portions toward the both right and left ends are disposed at specified intervals in a transverse direction in said comforter;

spaces are left between the side ends of said parting cloth members and side edges of said comforter, respectively; and the width of the front cloth cover is wider than the width of the back cover cloth, and the front cover cloth is bulged out as a whole.

2. A comforter according to claim 1, wherein peripheral spaces are separated from central area of said comforter by providing parting cloth members in lengthwise direction, said parting cloth members in lengthwise direction being spaced from the side edges of said comforter.

3. A comforter according to claim 2, wherein said peripheral space is further divided into a plural number of spaces by extending said parting cloth members in crosswise direction.

4. A comforter according to claim 3, wherein the height of said parting cloth members in a crosswise direction at the uppermost position is lower than that of the other transverse parting cloth members.

5. A comforter according to claim 1, 2, or 3, wherein each parting cloth member is made of a single cloth piece, and its upper edge portion is sewn to the front cover cloth while its lower edge portion is sewn to the back cover cloth.

6. A comforter according to claim 1, 2 or 3, wherein each parting cloth member is composed of an upper parting piece to be sewn to said front cover cloth and a lower parting piece to be sewn to said back cover cloth, and the parting cloth member for partitioning the inside of the comforter is made by sewing said upper parting cloth piece and the lower parting cloth piece together.

7. A comforter according to claim 6, wherein the lower parting piece is formed into protruding arc shape, while the upper parting piece is shaped into a tape-form, the length of the upper edge of said lower parting piece and the length of the lower edge of said upper parting piece which are to be sewn together being almost the same as each other.

8. A comforter according to claim 1, 2 or 3, wherein each of said parting cloth members, whose height is gradually lowered toward both ends, has the same height at the center areas for a specified range of the comforter.

9. A comforter according to claim 8, wherein the height of the center area of said parting cloth members in a crosswise direction in said comforter is the same both in upper and lower portions of the comforter, and the range of the center area of the parting cloth members with the same height is made longer for the parting cloth members disposed in the upper portion of the comforter than that of those disposed in the lower portion of the comforter.

10. A comforter according to claim 3, wherein the height of the center area of said parting cloth members in a crosswise direction disposed in the lower portion of said comforter is lower than that of the parting cloth members disposed in the upper portion of said comforter.

11. A comforter according to claim 1, 2 or 3, wherein the intervals between the respective parting cloth members provided in crosswise direction are made constant, and the interval between the uppermost parting cloth member and the upper edge of the comforter is made larger than each of said intervals between the respective parting cloth members.

12. A comforter according to claim 1, 2, or 3, wherein the space formed between the uppermost crosswise parting cloth member and the upper edge of the comforter is divided into a plural number of subspaces by parting cloth members provided in lengthwise direction.

* * * * *